US005465595A

United States Patent [19]

Sheppard

[11] Patent Number: 5,465,595

[45] Date of Patent: Nov. 14, 1995

[54] DEAD BOLT PASS KEY LOCK

[76] Inventor: Harold A. Sheppard, P.O. Box 1401, Inola, Okla. 74036

[21] Appl. No.: 253,012

[22] Filed: May 31, 1994

[51] Int. Cl.[6] ..... E05B 13/08

[52] U.S. Cl. ..... 70/416; 70/211; 292/246; 292/264

[58] Field of Search ..... 70/416, 429, 430, 70/210, 211, 93; 292/246, 264, 288; 403/327, 100, 166

[56] References Cited

U.S. PATENT DOCUMENTS

| | | | |
|---|---|---|---|
| 2,066,182 | 12/1936 | Lenz | 403/100 |
| 3,073,144 | 1/1963 | Papanti | 70/211 |
| 3,585,827 | 6/1971 | Dominguez | 70/416 |
| 3,748,882 | 7/1973 | Dusault, Jr. et al. | 70/416 |
| 4,054,310 | 10/1977 | Coopersmith | 292/264 |
| 4,520,546 | 6/1985 | Darnell | 403/327 X |
| 4,827,745 | 5/1989 | Baugh | 70/211 X |
| 5,000,498 | 3/1991 | Upchurch | 292/288 |
| 5,193,373 | 3/1993 | Hunt | 70/416 |

FOREIGN PATENT DOCUMENTS

| | | | |
|---|---|---|---|
| 563907 | 1/1943 | United Kingdom | 403/327 |

*Primary Examiner*—Peter M. Cuomo
*Assistant Examiner*—Monica E. Millner
*Attorney, Agent, or Firm*—Robert K. Rhea

[57] ABSTRACT

A dead bolt operating knob is immobilized by dual sleeves mounted on a rod-like support and biased toward each other to surround opposing portions of the dead bolt operating knob. The end of the elongated support opposite the sleeve members is secured in a dead bolt door locked position by a flexible member extending between the end of the support opposite the sleeve members and the shaft of a doorknob assembly.

6 Claims, 2 Drawing Sheets

DEAD BOLT PASS KEY LOCK

BACKGROUND OF THE INVENTION

This invention relates to dead bolt locks and more particularly to a device preventing pass key retraction of a dead bolt.

1. Field of the Invention

Motels, apartments and the like are customarily provided with dead bolt locks for security of the occupants against unauthorized entry of the premises.

A dead bolt lock includes a plunger, generally referred to as a "bolt", having flat sides which is movable into and out of a complementary receptacle in an adjacent door jamb. The dead bolt lock is operated by a key from the outer side of the door, and is operated by a handle or knob from the inner or room side of the door. The knob is spaced from the inner side of the door by a shaft and is angularly rotated through a substantial angle in moving between locked and unlocked positions. The dead bolt lock can be operated from the inner side of the door by grasping and turning the knob while the dead bolt lock can be operated from the outer side of the door only by turning a key.

When a dead bolt lock is opened by a key, the knob also pivots through a predetermined angle. If pivoting movement of the knob from its locked position to its unlocked position is prevented, the dead bolt lock cannot be opened from the outer side of the door.

The owner and maintenance personnel of for-rent establishments are customarily provided with a pass key permitting them to enter the respective room or suite.

Occasionally the pass key or a duplicate thereof is obtained by unauthorized persons who may then gain entry to the premises while occupied by a customer.

This invention provides a locking arm member, which may be installed and removed by the room occupant, which substantially envelops the dead bolt operating knob on the inside of an entry door to prevent angular rotation of the knob and withdrawing the dead bolt by the use of a pass key.

2. Description of the Prior Art

U.S. Pat. No. 5,193,373, issued Mar. 16, 1993 to Hunt for SECURITY DEVICE FOR DEAD BOLT LOCK, discloses a body member having a space for receiving a dead bolt lock handle and a slidable retainer on the body for locking the handle to the body member with a pin. The pin end of the body member is attached to one end of a flexible connecter having its other end fixed to an attachment plate mounted on the door face above the position of the dead bolt lock which prevents the body member and handle from rotating in response to the use of a dead bolt key on the outside of the door.

U.S. Pat. No. 3,748,882 issued Jul. 31, 1973 to Dusault, Jr. et al for SECURITY LOCK and U.S. Pat. No. 5,000,498 issued Mar. 19, 1991 to Upchurch for INTERIOR DEAD BOLT KNOB FASTENING APPARATUS are believed good examples of the further state-of-the-art.

Each of the above named patents require some portion of the dead bolt knob securing device to be permanently attached to some portion of the door face or the dead bolt lock mechanism, whereas applicant's device simply envelops the major portion of the dead bolt knob on the inside of a door and does not require attachment to the door or the dead bolt lock mechanism and may be easily installed in locking position and removed therefrom and be carried by the owner thereof from room to room.

SUMMARY OF THE INVENTION

A pair dual sleeve members are slideably mounted by one sleeve of each member on one end portion of a rod-like support. At least one dual sleeve member is spring biased toward the other. The other sleeve of each dual sleeve member, respectively, surrounds one end portion of a dead bolt lock knob. The other end portion of the rod-like support projects substantially parallel with and beyond the length of the dead bolt plunger when in dead bolt locked postion and is connected at its end portion remote from the dual sleeves with one end of an elongated flexible member, preferrably a small chain which is secured intermidate its ends with the shaft of a conventional doorknob assembly and prevents angular rotation of the dead bolt knob by the use of a pass key on the outside of the door.

The principal object of this invention is to provide a portable easily installed manually dead bolt security device for the privacy of an occupant or a room or dwelling which surrounds respective end portions of a dead bolt operating knob in a door locked position against withdrawal of the dead bolt by use of a pass key and in which the device is easily removed when not needed and transported by the room occupant from room to room.

DESCRIPTION OF THE PREFERRED EMBODIMENTS

Figure 1:
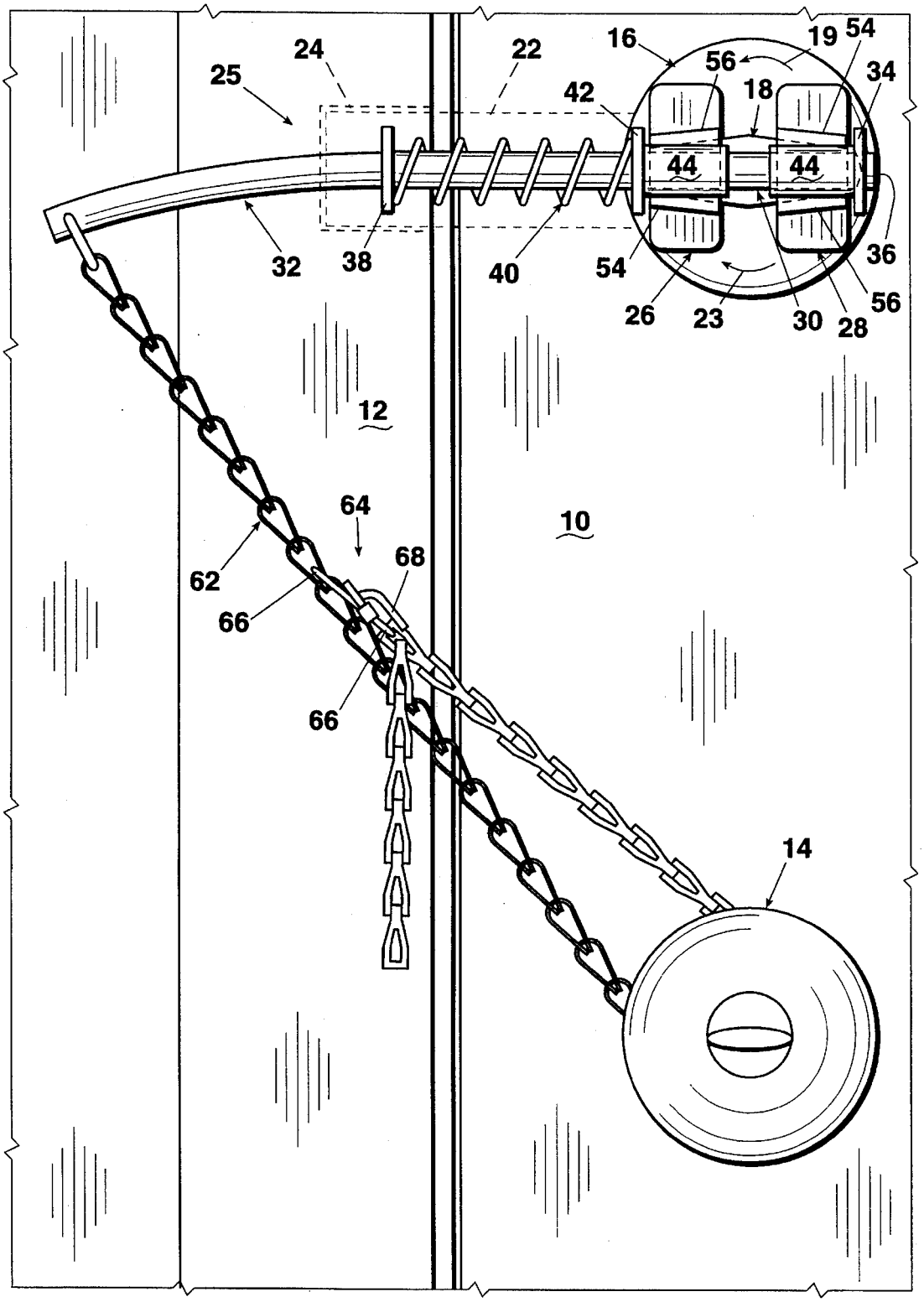
FIG. 1 is a fragmentary elevational view of a dead bolt equipped door and a door jam having the device installed thereon.

Like characters of reference designate like parts in those figures of the drawings in which they occur.

The reference numeral 10 indicates a fragment of a typical door having one edge disposed adjacent the edge of a companion door jamb 12.

The door 10 is provided with conventional doorknob assembly 14, and additionally a dead bolt lock is installed on the door usually above the position of the doorknob assembly 14.

The dead bolt lock 16 is of conventional construction and includes, on the inside of the door a manually operated knob 18, of truncated end substantially diamond shape in top view, connected with a shaft 20 extending into the dead bolt mechanism within the door so that angular rotation of the knob in the direction of the arrow 19 about the center line or axis of the shaft 20 throws the dead bolt plunger or bolt portion 22 which, at its end portion remote from the knob 18, enters a socket 24 formed in the adjacent edge portion of the door jamb 12 (FIG. 1). Conversely, angularly rotating the knob 18 in the direction of the arrow 23 withdraws the dead bolt plunger 22.

The above description is substantially conventional with dead bolt equipped entry doors and is set forth to show the combination with which the present invention is designed to be used.

The reference numeral 25 indicates the dead bolt knob locking device as a whole which is elongated in general configuration.

The device 25 comprises a pair of dual sleeve members 26 and 28 slideably supported for movement toward and away from each other on one end portion 30 of a rod-like support 32. A split ring 34 surrounds the support 32 adjacent its end 36 to prevent separation of the sleeve members 26 and 28 relative to the support.

An abutment, such as a washer 38, surrounds and is fixed to the support 32 intermediate it ends and a spring 40 surrounds the support between the washer 38 and a slideable washer 42 surrounding the support for biasing the sleeve member 26 toward the sleeve member 28 and in cooperative transversely surrounding relation on end portions of the dead bolt knob 18.

Since the sleeve members 26 and 28 are mirror images of each other, only the sleeve member 26 is described in detail. The sleeve member 26 comprises a first or primary sleeve portion 44 having opposing parallel end surfaces 46 and 48 and a through bore 50 which cooperatively surrounds an intermediate portion of the support end portion 30. The sleeve member 26 further includes a second or a companion sleeve 52 having a substantially rectangular opening 53 in axial parallel relation with respect to the longitudinal axis of the sleeve bore 50.

The sleeve 52 is formed by opposing spaced apart side walls 54 and 56 integrally secured at their upper end portions to a peripheral portion of the sleeve 44 and are joined at their ends opposite the sleeve 44 by a planar base member 58 preferably extending laterally a selected distance beyond the sleeve side walls 54 and 56.

Figure 2:
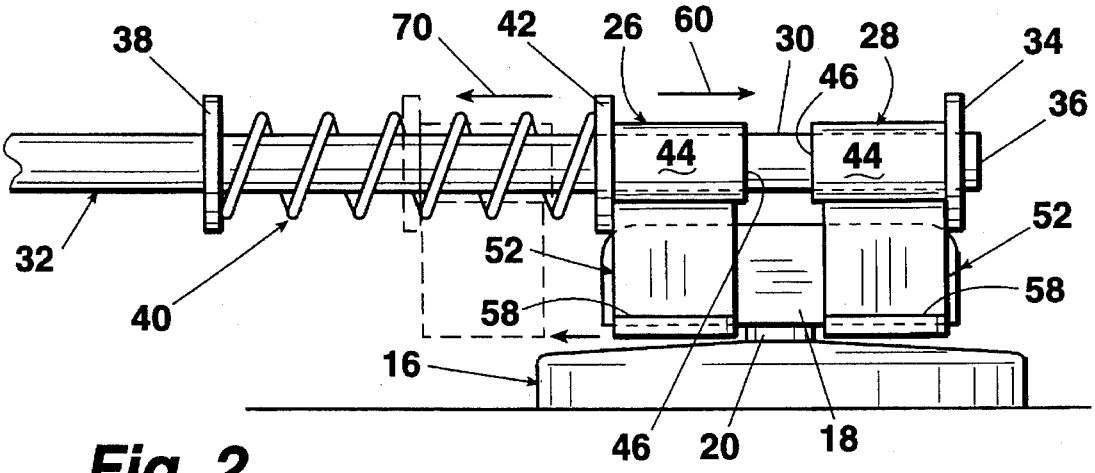
FIG. 2 is a fragmentary side elevational view, to a larger scale, of the dead bolt knob securing end portion of the device.
Figure 3:
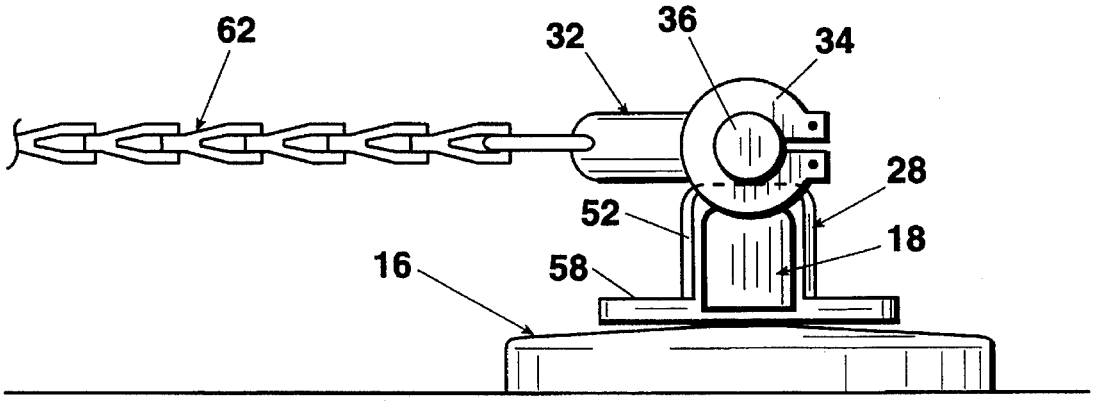
FIG. 3 is a fragmentary end elevational view of FIG. 2.
Figure 4:
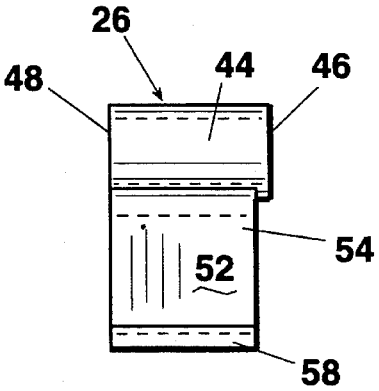
FIG. 4 is a side elevational view of one of the dual sleeve members, per se; and, FIG. 5 is a left end elevational view of FIG. 4.
Figure 5:
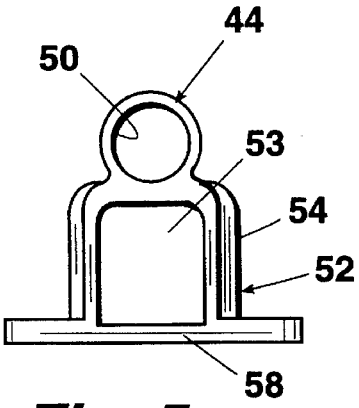

As best seen in FIG. 1, the sleeve walls 54 and 56 converge in a direction opposite the sleeve end surface 46 on an angle complementary with respect to the opposing side surfaces of the diamond-shaped walls defining the sides of the knob 18 for cooperatively contiguously contacting opposing sides of the knob 18 in response to the spring 40 biasing the sleeve member 26 toward the sleeve member 28 in the direction of the arrow 60 (FIG. 2).

One end portion of an elongated flexible member 62 preferably a chain is connected with the end portion of the support 32 opposite its end portion 30. An intermediate portion of the flexible member or chain 62 extends around the shaft of the doorknob assembly 14 and its end portion opposite the support 32 is releasably connected with an intermediate portion of the chain by a toggle joint clamp 64 commonly known as a "load binder".

The load binder 64 comprises an opposing pair of hooks 66, which are engaged with selected links of the chain, and are pivotally connected in offset relation at their other end portions with a handle 68 which, when pivoted toward its locked position, pulls the hook connected links of the chain toward each other to tighten the chain to a taut position between the support 32 and the doorknob assembly which prevents upward movement of the chain connected end portion of the support 32, as viewed in the drawings, or a dead bolt knob unlocking movement in the direction of the arrow 23

OPERATION

In operation the user places the sleeve 52 of the sleeve member 28 over the end portion dead bolt knob 18 opposite the door jamb while manually holding the other sleeve member 26 against the resistance of the spring 40, as illustrated by dotted lines (FIG. 2). With the sleeve 52 of the sleeve member 26 in substantial axial alignment with the adjacent end of the knob 18, the sleeve member 26 is released so that the spring 40 may bias it into cooperative engagement with the end of the knob 18 opposite the sleeve member 28.

In this position the support 32 end portion opposite its end 36 projects in a substantially horizontal direction preferable curved downwardly, beyond the adjacent edge of the door jamb 12. The chain 62 is then looped around the doorknob of the shaft of the assembly 14 and secured by the load binder 64, as described hereinabove, thus preventing unauthorized entry of the dwelling space by the use of a pass key on the outside of the door.

The lock assembly 25 is removed from the knob 18 by releasing the load binder by pivoting its handle 68 in a toggle joint releasing action and removing the chain from the doorknob assembly. The sleeve members 26 and 28 may then be manually removed by reversing the above and described installing sequence.

Alternatively, the device 25 may be removed from the dead bolt knob 18 by manually moving the sleeve member 26 in the direction of the arrow 70 and releasing the other sleeve member 28 from the knob 18 and removing the chain 64 from the doorknob assembly without releasing the load binder handle 68.

Obviously the invention is susceptible to changes or alterations without defeating its practicability. Therefore, I do not wish to be confined to the preferred embodiment shown in the drawings and described herein.

I claim:

1. A dead bolt pass key lock for a door having inner and outer sides and having a dead bolt lock disposed above a doorknob assembly, said dead bolt having a manually operated knob having opposing end portions spaced from the inner side of the door, said knob being angularly rotatable between a dead bolt plunger thrown door locked position and a dead bolt plunger retracted door unlocked position, the improvement comprising:

an elongated support having opposite end portions;

dual sleeve means including a pair of dual sleeve members having respective confronting end surfaces slidably mounted on one of said opposite end portions of said support for movement toward and away from each other and surrounding opposing end portions of the dead bolt knob, each dual sleeve member of said pair of dual sleeve members comprising superposed sleeves having a wall portion in common;

resilient means for biasing said sleeve means toward each other; and, a flexible connecting means conected between the other of said opposite end portions of said support and said doorknob assembly for preventing the dead bolt knob being moved from a door locked position to an unlocked position.

2. The combination according to claim 1 in which one sleeve of each dual sleeve member is characterized by opposing side walls converging opposite its confronting end surface and bridged by a planar base wall.

3. The combination according to claim 2 in which the flexible element comprises: a chain; and, toggle joint means securing the chain to the doorknob assembly.

4. A dead bolt pass key lock for a door having inner and outer sides and having a dead bolt lock disposed above a doorknob assembly, said dead bolt having a manually operated knob having opposing end portions spaced from the inner side of the door, said knob being angularly rotatable about a horizontal axis between a dead bolt plunger thrown door locked position and a dead bolt plunger retracted door unlocked position, the improvement comprising:

an elongated rod-like support having opposite end portions;

a pair of dual sleeve means slidably mounted on one of said opposite end portions of said support, said sleeve means of the pair of dual sleeve means having confronting end surfaces, each dual sleeve means of said pair of dual sleeve means comprising superposed sleeves having a wall portion in common, at least one of said sleeve means being moveable toward and away from the other sleeve means between a restraining position surrounding opposing end portions of the dead bolt knob and a release position for releasing said pair of sleeve means from the dead bolt knob;

spring means for biasing said sleeve means toward each other; and, a flexible element extending between and securing the other of said opposite end portions of said support to said doorknob assembly for preventing angular rotation of said support about the horizontal axis of the dead bolt knob.

5. The combination according to claim 4 in which one sleeve of each dual sleeve member is characterized by opposing side walls converging opposite its confronting end surface and bridged by a planar base wall.

6. The combination according to claim 5 in which the flexible element comprises:

a chain; and, toggle joint means securing the chain to the doorknob assembly.

* * * * *